US005227086A

United States Patent [19]

Kacher et al.

[11] Patent Number: 5,227,086

[45] Date of Patent: * Jul. 13, 1993

[54] FRAMED SKIN PH CLEANSING BAR

[75] Inventors: Mark L. Kacher, Mason; James E. Taneri, West Chester; Diane G. Schmidt; Teresa K. Wong, both of Cincinnati, all of Ohio

[73] Assignee: The Procter & Gamble Company, Cincinnati, Ohio

[ * ] Notice: The portion of the term of this patent subsequent to Jul. 6, 2010 has been disclaimed.

[21] Appl. No.: 854,933

[22] Filed: Mar. 20, 1992

[51] Int. Cl.[5] ..... C11D 9/48; C11D 10/04; C11D 13/12; C11D 13/16

[52] U.S. Cl. ..... 252/112; 252/108; 252/109; 252/110; 252/111; 252/113; 252/117; 252/118; 252/121; 252/122; 252/131; 252/134; 252/174; 252/368; 252/370; 252/DIG. 5; 252/DIG. 16

[58] Field of Search ..... 252/108, 109, 110, 111, 252/117, 118, 121, 122, 131, 132, 134, 174, 367, 368, 369, DIG. 16, 112, DIG. 5, 554, 557, 370

[56] References Cited

U.S. PATENT DOCUMENTS

| | | | |
|---|---|---|---|
| 2,826,551 | 3/1958 | Geen | 252/89 |
| 2,988,511 | 6/1961 | Mills et al. | 252/121 |
| 2,988,551 | 6/1961 | Morren | 260/268 |
| 3,351,558 | 11/1967 | Zimmerer | 252/137 |
| 3,557,006 | 1/1971 | Ferrara et al. | 252/117 |
| 3,835,058 | 9/1974 | White | 252/121 |
| 3,835,059 | 9/1974 | Fukuta et al. | 252/305 |
| 4,234,646 | 11/1980 | Morshauser | 252/544 |
| 4,606,839 | 8/1986 | Harding | 252/132 |
| 4,673,525 | 6/1987 | Small et al. | 252/132 |
| 4,704,223 | 11/1987 | Gupta et al. | 252/132 |
| 4,954,282 | 9/1990 | Rys et al. | 252/117 |

FOREIGN PATENT DOCUMENTS

| | | |
|---|---|---|
| 57-61800 | 12/1982 | Japan . |
| 60-23156 | 6/1985 | Japan . |
| 513696 | 10/1938 | United Kingdom . |

*Primary Examiner*—Dennis Albrecht
*Attorney, Agent, or Firm*—Leonard Williamson

[57] ABSTRACT

The invention provides a firm, low smear, ultra mild, weakly acidic skin pH cleansing bar comprising by weight of said bar: from about 5% to about 50% of essentially free carboxylic acid, preferably myristic acid, behenic acid, or 12-hydroxy stearic acid; from about 15% to about 65% of a water-soluble organic anionic and/or nonionic bar firmness acid, preferably sodium cocoyl isethionate or sodium lauroyl isethionate; and from about 15% to about 55% water. The skin pH bar can contain little or no soap, yet has a shallow penetration value of from zero up to 12 mm. The bar is a framed bar.

26 Claims, No Drawings

FRAMED SKIN PH CLEANSING BAR

TECHNICAL FIELD

This invention relates to carboxylic acid based cleansing bars.

BACKGROUND

Firm, low smear, skin pH or weakly acidic cleansing bars as defined herein, are believed to be novel. U.S. Pat. No. 3,557,006, Ferrara et al., issued Jan. 19, 1971, discloses a composite soap bar having an acid pH in use. Also see U.K. Pat. Specification 513,696, Mangeot, accepted Oct. 19, 1939. Jap. Pat. Application. No. 54-151410, filed Nov. 21, 1979, and published Jun. 6, 1985, discloses a weakly acidic cleansing cream, but useful solids are not disclosed. A "weakly acidic" bar has a pH of from about 4.8 to about 6 which is distinguished from a neutral pH bar.

Commercial neutral pH bars, e.g., DOVE®, CARESS®, and OLAY ®, usually contain only a maximum of about 5% moisture. Prior art neutral pH bars containing substantial levels of hygroscopic materials, soft solids, or liquids, including water, are soft or sticky with poor smears; such prior art neutral pH bars are soft or have relatively poor smears.

Cleansing bars, per se, with reduced bar smear are reported in the art. E.g., U.S. Pat. No. 2,988,511, Mills, issued Jun. 13, 1961, incorporated herein by reference, discloses a low smearing bar.

Bar smear, also referred to as bar sloth, is the soft solid or mush that forms at the surface of a bar when submerged in water and is regarded by consumers as messy, unattractive, and uneconomical.

High moisture and low smear personal cleansing bars are disclosed in U.S. Pat. No. 4,606,839 Harding, issued Aug. 19, 1986. Harding uses coconut and/or palm kernel oil soap.

However, an examination of a used personal cleansing bars in today's average bathroom will show that there is still a need to improve cleansing bar smear.

Bar smear is especially poor in neutral pH bar formulations which contain higher levels (50%±10%) of synthetic surfactant.

The formation of rigid, soap curd fibers of sodium laurate is reported by L. Marton et al. in a 1940 Journal of American Chemical Society (Vol. 63, pp. 1990–1993). The report does not teach a utility for the soap curd. Shaped solids, as defined herein, are not disclosed by Marton et al. Additionally, the formation of this curd of fibers does not disclose free mono- and/or dicarboxylic acids.

Japanese Pat. J5 7030-798, Jul. 30, 1980, discloses transparent solid framed or molded soap bar in which fatty acids constituting the soap component are myristic, palmitic, and stearic acids. A transparent soap is described in which at least 90 wt.% of the fatty acids which constitute the soap component are myristic acid, palmitic acid, and stearic acid. The product is reported as a transparent, solid soap having good frothing and solidifying properties, good storage stability, and a low irritant effect on human skin. The process and transparent bar soap composition exemplified in Jap. J5 7030-798 do not appear to contain synthetic surfactant.

It is an object of the present invention to produce a firm, mild, skin pH, low smear cleansing bar that contains relatively high level of moisture in the presence of a synthetic surfactant and soft solids, such as water-soluble polyols and hydrocarbon greases.

SUMMARY OF THE INVENTION

The invention provides a firm, ultra mild, weakly acidic skin pH cleansing bar comprising by weight of said bar: from about 5% to about 50% of essentially free monocarboxylic acid; from about 15% to about 65% of a water-soluble organic anionic and/or non-ionic bar firmness aid; and from about 15% to about 55% water. The bar can contain little or no soap, and yet the firm skin pH cleansing bar has a penetration value of from zero up to 12 mm.

DETAILED DESCRIPTION OF SKIN pH BAR

The present invention provides a firm, ultra mild, weakly acidic skin pH cleansing bar comprising by weight of said bar: from about 5% to about 50% of essentially free carboxylic acid; from about 15% to about 65% of a water-soluble organic anionic and/or nonionic bar firmness aid; and from about 15% to about 55% water.

The term "water-soluble" with respect to the "bar firmness aid" means at least 80% water-soluble at temperature of about 76°–96° C.

The terms "carboxylic acid" and "monocarboxylic acid" are used interchangeably unless otherwise specified.

"Essentially free carboxylic acid" as defined herein means that the "free" carboxylic acid is from about 85% to about 100% by weight of free and no more than about 15% neutralized carboxylic acid. In other words, any neutralized carboxylic acid present is from 0% to about 15% by weight of the carboxylic acid.

A neutralized carboxylic acid can have a cation selected from the group consisting of sodium, magnesium, calcium, aluminum, and mixtures thereof, but this is defined as an essentially free carboxylic acid bar.

The terms "neutralized carboxylic acid," "soap", "fatty acid (FA) salts" and "monocarboxylic acid salts" as used herein are used interchangeably.

The firm cleansing bar has a penetration value of from zero up to 12 mm as measured at 25° C., preferably at 50° C., using a 247 gram Standard Weighted Penetrometer Probe having a conical needle attached to a 9 inch (22.9 cm) shaft, weighing 47 grams with 200 grams on top of said shaft for a total of said 247 grams, said conical needle having a 19/32 inch (1.51 cm) top and a 1/32 inch (0.08 cm) point.

Since healthy human skin is slightly acidic (pH from about 4.8 to about 6.0), it is desirable that a skin cleansing bar also have a similar, slightly acidic pH. Additionally, such formulations can contain high levels of carboxylic acid while containing very little, if any, harsh soap.

In another respect, the present invention provides a firm, ultra mild, weakly acidic skin pH cleansing bar comprising: at least two phases and a sum total of from about 5% to about 50% of free carboxylic acid or a mixture of free and neutralized carboxylic acid; from about 15% to about 65% of an anionic and/or nonionic bar firmness aid of which at least about 10% by weight of said bar is a synthetic surfactant; and from about 15% to about 55% water by weight of said bar.

One particularly surprising aspect of the present invention is that a bar firmness aid is required to form an acceptably firm bar. These bar firmness aids include co-solvents such as propylene glycol and synthetic surfactants, such as sodium acyl isethionate. These bar firmness aids typically result in bar softening in conventional bars, especially in the presence of relatively high levels of water; but in the present invention serve to firm up the bar.

In another respect, the bar of the present invention comprises a rigid crystalline phase skeleton structure comprising an interlocking, open three-dimensional mesh of elongated crystals consisting essentially of said essentially free carboxylic acid.

Another phase in the bar of the present invention is an aqueous phase mix. The aqueous mix (when measured alone without carboxylic acid) has a penetration value of greater than 12 mm to complete penetration at 25° C.

More specifically, the skeleton structure is a relatively rigid, interlocking, open, three-dimensional mesh of free or essential free monocarboxylic acid elongated crystals.

The "elongated crystals" are platelets and/or fibers.

The terms "skeleton structure," "skeletal structure," "core," and "skeleton frame" are often used interchangeably herein.

The term "shaped solid" as used herein includes forms such as bars, cakes, and the like. The term "bar" as used herein includes the same unless otherwise specified.

The term "mesh" as used herein means as interlocking crystalline skeleton network with voids or openings when viewed under magnification of from about 1000× to about 5000× by scanning electron microscopy.

The three-dimensional mesh can be seen using a Scanning Electron Microscope. The Scanning Electron Microscopy (SEM) sample preparation involves fracturing a bar (shaped solid) with simple pressure to obtain a fresh surface for examination. The fractured sample is reduced in size (razor blade) to approximately a 10 mm×15 mm rectangle with a thickness of about 5 mm. The sample is mounted on an aluminum SEM stub using silver paint adhesive. The mounted sample is coated with approximately 300 angstroms of gold/palladium in a Pelco sputter coater. Prior to coating, the sample is subjected to vacuum for a period of time which is sufficient to allow sufficient loss of bar moisture assuring acceptable coating quality. After coating, the sample is transferred to the SEM chamber and examined under standard SEM operating conditions with an Hitachi Model S570 Scanning Electron Microscope in order to see the skeletal (core) frame.

The elongated crystals are composed of essentially free carboxylic acid and are therefore are different from the soap, primarily neutralized carboxylic acid, elongated crystals of commonly assigned U.S. patent application Ser. No. 07/617,827, Kacher et al., filed Nov. 26, 1990, now abandoned in favor of commonly assigned U.S. patent application Ser. No. 07/782,956, filed Nov. 1, 1991, incorporated herein by reference.

In another respect, the present invention provides an improved firm, skin pH cleansing bar which is comprised of said skeleton structure. Some shaped solids are in the form of cleansing bars which contain surprisingly high levels of said aqueous phase comprising water, other liquids and soft materials. Not-withstanding the presence of relatively large levels of an aqueous phase, the preferred bars of the present invention maintain their rigidity and excellent smear properties, even when allowed to soak overnight in water. While not being bound to any theory, the shaped solid comprising these phases is similar to a relatively rigid wet sponge.

The crystalline phase comprises elongated crystals in the form of either interlocking platelets and/or fibers, usually platelets. Preferably said crystals are composed of free fatty acids. The interlocking mesh of said fibers and/or platelets imparts strength to the three-dimensional structure, even in the presence of relatively high levels of water or other soft materials; even when allowed to soak overnight in water.

The bar firmness, i.e., strength of the skeleton structure, can be measured by the resistance to penetration of the bar using a Standard Weighted Penetrometer Probe. See Bar Hardness Test below from more details. The bar is of sufficient firmness or rigidity that a 20 mm thick or greater cleansing bar sample has a penetration at 25° C. of from about zero mm to about 12 mm, preferably from about 1 mm to about 10 mm, more preferably from about 3 mm to about 8 mm.

The present bars are distinguished from conventional transparent bars based on crystal size, as well as other characteristics. The crystals or crystal bundles that make-up the interlocking mesh structure of the present invention preferably are of a size that diffracts light and consequently are greater than 400 nm in either diameter or length. On the other hand, conventional transparent bars gain their transparency by having crystal diameters or length less than the wavelength of white light, which is greater than about 400 nm and, consequently, do not diffract light.

While not being bound to any theory, the skeletal structure is theorized to contain substantial "void" areas which are filled by soft and/or liquid aqueous phases. It is a surprising aspect of this invention that the physical properties of the bar, such as bar hardness and little smear, are mostly dependent on the crystalline interlocking mesh structure, even when the other phases make up a majority of the materials present. In conventional bars, many components can impact the overall bar physical properties because the components either modify the phase and structure of the soap or synthetic surfactant components that primarily determine the bar's physical properties. The combination of two or more phases (e.g., soap and aqueous solution) drastically changes the colloidal structure, and consequently, the physical properties of a conventional bar.

Thus, conventional bars are more limited in the type, levels and composition of soft phase materials that can be incorporated into the bar than the present invention. Such phases include most materials that are either flowable liquids or materials that are softer than the minimum hardness of an acceptable bar. These phases include aqueous solutions, liquid crystalline phases composed of water and surfactant, polymers; particularly surfactant-containing crystalline phases, and especially hygroscopic surfactants, which tend to become soft and sticky when mixed with water or other liquid phases including water-soluble organics (e.g., propylene glycol and glycerine), hydrophobic materials (e.g., mineral oil, liquid triglycerides), or soft hydrophobic materials, e.g., petrolatum, low melting paraffin, and low melting triglycerides.

In physical terms, all these phases can be characterized as being flowable liquids or so soft that a Standard Weighted Penetrometer Probe, as defined herein, will penetrate all the way through a 12 mm thick sample, in other words, greater than 12 mm. These phases can be selectively included in the structure of the present invention without loss of the interlocking mesh structure and certain desirable physical properties.

The Carboxylic Acid

The invention is a firm, low smear, ultra mild, skin pH bar comprising free, or essentially free monocarboxylic acid elongated crystals.

In a preferred embodiment, said elongated crystals are composed of essentially free carboxylic acid, free fatty acid, of which at least about 15% have saturated fatty alkyl chains of a single chain length. The free fatty acid is at least 85% by weight of the sum total of free and neutralized carboxylic acid in the skin pH cleansing bar formulation.

A preferred skin pH bar contains essentially standard mono-carboxylic acid, wherein at least 80% of said mono-carboxylic acid has the following general formula:

$$H-(CH_2)_a-\underset{\underset{X}{|}}{CH}-(CH_2)_b-CO_2-H$$

wherein:

a+b=10 to 20 each a, b=0 to 20

X=H, OR, $$O-\overset{\overset{O}{\|}}{C}-R_1,$$

R, or mixtures thereof;

R=$C_1$–$C_3$ alkyl, H, or mixtures thereof;

$R_1$=$C_1$–$C_3$ alkyl.

The carboxylic acids are preferred when: X=H, and a+b=12–20, or X=OH, a=10–16, b=0, or 12-hydroxy stearic acid for said monocarboxylic acid. 12-hydroxy stearic acid forms fibrous elongated crystals.

The ultra mild, weakly acidic skin pH cleansing bar is preferred when said neutralized carboxylic acid is a sodium salt and the free carboxylic acid and neutralized carboxylic acid sum is from about 10% to about 40%, more preferably from about 15% to about 25%–30%, by weight of the bar.

The ultra mild, weakly acidic skin pH cleansing bar is preferred when said essentially free monocarboxylic acid contains from 0% to about 5% neutralized monocarboxylic acid.

A highly preferred monocarboxylic acid is selected from the group consisting of myristic acid, behenic acid, and 12-hydroxy stearic acid, and mixtures thereof.

Bar Firmness Aid

The ultra mild, weakly acidic skin pH cleansing bar's firmness aid is a water-soluble organic preferably selected from the group consisting of:

I. from about 10% to about 50% by weight of a synthetic surfactant wherein said synthetic surfactant is selected from the group consisting of: alkyl sulfates, paraffin sulfonates, alkyl glyceryl ether sulfonates, anionic acyl sarcosinates, methyl acyl taurates, linear alkyl benzene sulfonates, N-acyl glutamates, alkyl glucosides, alpha sulfo fatty acids esters, acyl isethionates, glucose amides, alkyl sulfonsuccinates, alkyl ether carboxylates, alkyl phosphate esters, ethoxylated alkyl phosphate esters, methyl glucose esters, protein condensates, the alkyl ether sulfates with 1 to 12 ethoxy groups, and mixtures thereof, wherein said surfactants contain $C_8$-$C_{22}$ alkylene chains; and mixtures thereof; and II. from 0% to about 40%, preferably to about 30%, by weight of a co-solvent wherein said co-solvent is selected from the group consisting of:

(a) non-volatile, water-soluble nonionic organic solvents selected from the group consisting of: a polyol of the structure:

$$R_3-O(CH_2-\underset{\underset{R_4}{|}}{CH})_kH$$

where $R_3$=H or $C_1$–$C_4$ alkyl; $R_4$=H or $CH_3$; and k=1–200; $C_2$–$C_{10}$ alkane diols; sorbitol; glycerine; sugars; sugars derivatives; urea; and ethanol amines of the general structure $(HOCH_2CH_2)_xNH_y$ where x=1–3; y=0–2; and x+y=3;

(b) alcohols of from 1 to 5 carbon atoms; and mixtures thereof; and

III. mixtures of (a) and (b).

It is surprising that synthetic surfactants and co-solvents act to firm up the bar of the present invention.

The synthetic surfactant is preferably from about 10% to about 40% by weight of said bar. The synthetic surfactant preferably contains $C_{10}$–$C_{18}$ alkylene chains and is a sodium salt.

The skin pH cleansing bar is more preferred when it contains synthetic surfactant at a level of from about 20% to about 30% by weight of said bar; And wherein said synthetic surfactant is a sodium salt selected from the group consisting of: alkyl sulfates, alkyl glyceryl ether sulfonates, linear alkyl benzene sulfonates, alpha sulfo fatty acid esters, acyl isethionates, glucose amides, ethoxylated alkyl ether sulfates with 1 to 6 ethoxy groups, and mixtures thereof, wherein said surfactants contain $C_{10}$–$C_{18}$ alkylene chains; and mixtures thereof.

The co-solvent level is preferably is from 0% to about 15% by weight of said bar.

The preferred water level is from about 20% to about 30% by weight of said bar.

A preferred synthetic surfactant is a sodium acyl isethionate selected from the group consisting of sodium cocoyl isethionate and sodium lauroyl isethionate, and mixtures thereof.

A preferred co-solvent level is from about 2% to about 15% by weight of said bar, and wherein said co-solvent is selected from the group consisting of: said polyol wherein $R_3$32 H, and k=1–5; glycerine; sugars; sugar derivatives; urea; said ethanol amines, and mixtures thereof. A more preferred co-solvent level is from about 2% to about 10% by weight of said bar, when the co-solvent is selected from the group consisting of: propylene glycol, sucrose, lactose, glycerine, and mixtures thereof. Preferred bar firmness aids have a solubility of at least 4 parts in 10 parts of water at 170°–180° F. (77°–82° C.).

Other Cleansing Bar Ingredients

The skin pH cleansing bar can contain from about 0.1% to about 60% of other cleansing bar ingredients selected from the group consisting of:

from about 0.5% to about 1% said potassium soap;

from about 0.5% to about 1% triethanolammonium soap;

from about 1% to about 40% of impalpable water-insoluble materials selected from the group consisting of calcium carbonate and talc;

from about 0.1% to about 20% of a polymeric skin feel aid;

from about 0.5% to about 25% of aluminosilicate clay and/or other clays;

wherein said aluminosilicates and clays are selected from the group consisting of zeolites; kaolin, kaolinite, montmorillonite, attapulgite, illite, bentonite, halloysite, and calcined clays;

from about 1% to about 40% of salt and salt hydrates; and mixtures thereof;

wherein said salt and salt hydrate have a cation selected from the group consisting of: sodium, potassium, magnesium, calcium, aluminum, lithium, ammonium, monoethanol ammonium, diethanolammonium, and triethanolammonium; and wherein said salt and said hydrate have an anion selected from the group consisting of: chloride, bromide, sulfate, metasilicate, orthophosphate, pyrophosphate, polyphosphate, metaborate, tetraborate, carbonate, bicarbonate, hydrogen phosphate, isethionate, methyl sulfate, and mono- and polycarboxylate of 6 carbon atoms or less;

from about 0.5% to about 30% of a starch;

from about 1% to about 20% of an amphoteric co-surfactant selected from the group consisting of alkyl betaines, alkyl sultaines, and trialkyl amine oxides; and mixtures thereof;

from about 0.1% to about 40% of a hydrophobic material selected from the group consisting of: microcrystalline wax, petrolatum, carnauba wax, palm wax, candelilla wax, sugarcane wax, vegetable derived triglycerides, beeswax, spermaceti, lanolin, wood wax, shellac wax, animal derived triglycerides, montar, paraffin, ozokerite, ceresin, and Fischer-Tropsch wax.

The preferred level of said amphoteric co-surfactant is from about 2% to about 10% and the amphoteric co-surfactant is selected from the group consisting of: cocobetaine, cocoamidopropylbetaine, cocodimethylamine oxide, and cocoamidopropyl hydroxysultaine.

The bar can preferably contain from about 2% to about 35% of said hydrophobic material; said hydrophobic material comprising paraffin wax, having a melting point of from about 49° C. (120° F.) to about 85° C. (185° F.), and petrolatum, and mixtures thereof; the bar more preferably contains from about 3% to about 15% by weight of the bar of paraffin wax.

The bar can preferably contain from about 1% to about 20% of said salts and said salt is selected from the group consisting of: sodium chloride, sodium sulfate, disodium hydrogen phosphate, sodium pyrophosphate, sodium tetraborate, sodium acetate, sodium citrate, and sodium isethionate, and mixtures thereof.

The bar can more preferably contain salt at a level of from about 4% to about 15% and said salt is preferably selected from the group consisting of sodium chloride and sodium isethionate.

The bar can preferably contain: from about 1% to about 15% by weight of said impalpable water-insoluble materials; from about 0.1% to about 3%, of said polymeric skin feel aid, said polymeric skin feel aid selected from the group consisting of guar, quaternized guar, and quaternized polysaccharides; from about 1% to about 15% said aluminosilicate and/or other clays; and from about 1% to about 15% said starch; wherein said starch is selected from the group consisting of corn starch and dextrin.

The aqueous phase mix alone contains from about 20% to about 95% water by weight of said aqueous phase. The aqueous phase can contain from about 35% to about 75% water by weight of said aqueous phase.

The skin pH bar can have miscellaneous non-carboxylic acid phases comprising droplets or crystals selected from waxes, petrolatum, and clays.

The above skin pH cleansing bar is preferred when said bar contains said free carboxylic acid and water; and some synthetic surfactant selected from the group consisting of: alkyl sulfates, paraffin sulfonates, alkylglycerylether sulfonates, acyl sarcosinates, methylacyl taurates, linear alkyl benzene sulfonates, N-acyl glutamates, alkyl glucosides, alpha sulfo fatty acid esters, acyl isethionates, alkyl sulfosuccinates, alkyl ether carboxylates, alkyl phosphate esters, ethoxylated alkyl phosphate esters, methyl glucose esters, protein condensates, alkyl amine oxides, alkyl betaines, alkyl sultaines, the alkyl ether sulfates with 1 to 12 ethoxy groups, and mixtures thereof, wherein said surfactants contain $C_8$–$C_2$ alkyl chains.

The above skin pH cleansing bar is preferred when said synthetic surfactant is hygroscopic; said hygroscopic surfactant being defined as a surfactant which absorbs at least 20% of its dry weight in water at 26° C. and 80% Relative Humidity in three days and wherein said bar is relatively non-swelling.

The above cleaning bar is preferred when said hygroscopic surfactant is selected from the group consisting of alpha sulfo fatty acid esters; alkyl sulfates; alkyl ether carboxylates; alkyl betaines; alkyl sultaines; alkyl amine oxides; alkyl ether sulfates; and mixtures thereof.

A Preferred Frame Process for Making the Bar

A process of making the above preferred cleansing bar of the present invention comprises the steps of:

A. forming a homogeneous pourable molten aqueous mixture of said water, said carboxylic acid, and said bar firmness aid with stirring at a temperature of from about 50° C. (120° F.) to about 95° C. (205° F.);

B. pouring said homogeneous pourable molten mixture into a bar shaped mold; and

C. crystallizing said molded molten mixture by cooling to provide said cleansing bar.

The stirring temperature of Step A is preferably about 75° C. to 95° C. The pourable molten mixture of Step B preferably has a viscosity between 10 cps and 4,000 cps when measured at a shear rate of from about 1 to about 5 $sec^{-1}$ at about 80° C.; preferably from about 100 cps to about 2,000 cps; more preferably from about 500 cps to about 1,000 cps.

In Step C the cooling is preferably under ambient conditions.

The skin pH bars of this invention are made by a frame process. A skin pH freezer bar and process which requires special conditions are disclosed in commonly assigned, copending U.S. patent application Ser. No. 854,927, Kacher et al., filed of even date, Mar. 20, 1992, incorporated herein by reference in its entirety.

The process aqueous mixture of Step A can comprise: from about 20% to about 30% of said water, from about 15% to about 25% of said carboxylic acid, and from about 20% to about 30% of synthetic surfactant.

The above process is preferred when the aqueous molten liquid is made without any neutralizing. However, in the aqueous mixture of said carboxylic acid some sodium soap may be formed.

The above process is preferred when from about 2% to about 15% by weight of said bar is a "crystallization enhancing salt" selected from the group consisting of: sodium or lithium salt of sulfate, chloride, acetate and citrate, and mixtures thereof.

The above process is preferred when said aqueous molten liquid aqueous phase contains from about 2% to about 40% of a bar firmness aid selected from the group disclosed herein.

The bar firmness aid appears to increase the level of said free, or essentially free, carboxylic acid dissolved in said continuous molten aqueous phase in Step I.

The above process is preferred when said aqueous phase contains from about 20% to about 95%, preferably from about 35% to about 75%, water by weight of said aqueous phase.

The above process is preferred when said bar has a penetration value at 25° C. of from about 3 mm to about 9 mm.

The above process is preferred when said bar has miscellaneous non-carboxylic acid phases comprising droplets or crystals selected from synthetic surfactants, waxes, petroleum, clays, and the like.

A highly preferred cleansing bar comprises: various combinations of the core structure of free carboxylic acid platelets and/or fibers, water, bar firmness aids, mild synthetic surfactants, bar appearance stabilizers, skin mildness aides and other cleansing bar adjuvants. Such preferred bar can be formulated to have essentially no bar smear.

Some compositions of this invention comprise the above-defined rigid mesh with water and without water. These compositions must be formed with water or another suitable solvent system. The compositions can be made with large amounts of water and the water level in the final composition can be reduced to as low as about 1% to 2%.

However, it is a special advantage of some structures described herein that they can be dehydrated without loss of the integrity of the mesh. Some preferred shaped solids can be dehydrated without appreciable change in their outer dimensions. Other bars shrink while maintaining their three-dimensional form. Some bars herein have the unique characteristic that they are not destroyed by dehydration.

The percentages, ratios, and parts herein are on a total composition weight basis, unless otherwise specified. All levels and ranges herein are approximations unless otherwise specified.

Some preferred compositions contain little or no short chain FA's of ten carbon atoms or less as shown in Table A by weight of the carboxylic acid.

| The Total Percent Unsaturated or Low ($C_{10}$ or less) Chain Length Carboxylic Acids | | |
|---|---|---|
| Broad | Preferred | More Preferred |
| 0–15% | 0–5% | 0–1% |

The highs and lows of some key preferred optional ingredients for complex cleansing bar compositions of this invention are set out herein. None of these ingredients is essential for the basic, preferred bar core structure. Zero is the lowest level for each optional ingredient. Some preferred bars can contain a total of from about 0.1% up to about 70% of such ingredients. The idea here is that the core bars can contain large amounts of other ingredients besides fatty acids, bar firmness aids, soap, and water.

Examples of suitable synthetic detergents for use herein, as bar firmness aids or as lather booster "co-surfactants," are those described in U.S. Pat. No. 3,351,558, Zimmerer, issued Nov. 7, 1967, at column 6, line 70 to column 7, line 74, said patent incorporated herein by reference.

Examples include the water-soluble salts of organic, sulfonic acids and of aliphatic sulfuric acid esters, that is, water-soluble salts of organic sulfuric reaction products having in the molecular structure an alkyl radical of from 10 to 22 carbon atoms and a radical selected from the group consisting of sulfonic acid and sulfuric acid ester radicals.

Synthetic sulfate detergents of special interest are the normally solid alkali metal salts of sulfuric acid esters of normal primary aliphatic alcohols having from 10 to 22 carbon atoms. Thus, the sodium and potassium salts of alkyl sulfuric acids obtained from the mixed higher alcohols derived by the reduction of tallow or by the reduction of coconut oil, palm oil, stearine, palm kernel oil, babassu kernel oil or other oils of the coconut group can be used herein.

Other aliphatic sulfuric acid esters which can be suitably employed include the water-soluble salts of sulfuric acid esters of polyhydric alcohols incompletely esterified with high molecular weight soap-forming carboxylic acids. Such synthetic detergents include the water-soluble alkali metal salts of sulfuric acid esters of higher molecular weight fatty acid monoglycerides such as the sodium and potassium salts of the coconut oil fatty acid monoester of 1,2-hydroxypropane-3-sulfuric acid ester, sodium and potassium monomyristoyl ethylene glycol sulfate, and sodium and potassium monolauroyl diglycerol sulfate.

The synthetic surfactants and other optional materials useful in conventional cleaning products are also useful in the present invention. In fact, some ingredients such as certain hygroscopic synthetic surfactants which are normally used in liquids and which are very difficult to incorporate into normal cleansing bars are very compatible in the bars in the present invention. Thus, essentially all of the known synthetic surfactants which are useful in cleansing products are useful in the compositions of the present invention. The cleansing product patent literature is full of synthetic surfactant disclosures. Some preferred surfactants as well as other cleansing product ingredients are disclosed in the following references:

| U.S. Pat. No. | Issue Date | Inventor(s) |
|---|---|---|
| 4,061,602 | 12/1977 | Oberstar et al. |
| 4,234,464 | 11/1980 | Morshauser |
| 4,472,297 | 9/1984 | Bolich et al. |
| 4,491,539 | 1/1985 | Hoskins et al. |
| 4,540,507 | 9/1985 | Grollier |
| 4,565,647 | 1/1986 | Llenado |
| 4,673,525 | 6/1987 | Small et al. |
| 4,704,224 | 11/1987 | Saud |
| 4,788,006 | 11/1988 | Bolich, Jr., et al. |
| 4,812,253 | 3/1989 | Small et al. |
| 4,820,447 | 4/1989 | Medcalf et al. |
| 4,906,459 | 3/1990 | Cobb et al. |
| 4,923,635 | 5/1990 | Simion et al. |
| 4,954,282 | 9/1990 | Rys et al. |

All of said patents are incorporated herein by reference. Some preferred synthetic surfactants are shown the Examples herein. Preferred synthetic surfactant systems are selectively designed for bar firmness, bar appearance stability, lather, cleansing and mildness.

It is noted that surfactant mildness can be measured by a skin barrier destruction test which is used to assess the irritancy potential of surfactants. In this test the milder the surfactant, the lesser the skin barrier is destroyed. Skin barrier destruction is measured by the relative amount of radio-labeled water ($^3H$-$H_2O$) which passes from the test solution through the skin epidermis into the physiological buffer contained in the diffusate chamber. This test is described by T. J. Franz in the *J. Invest. Dermatol.*, 1975, 64, pp. 190–195; and in U.S. Pat. No. 4,673,525, Small et al., issued Jun. 16, 1987, incorporated herein by reference, and which disclose a mild alkyl glyceryl ether sulfonate (AGS) surfactant based synbar comprising a "standard" alkyl glyceryl ether sulfonate mixture. Barrier destruction testing is used to select mild surfactants. Some preferred mild synthetic surfactants are disclosed in the above Small et al. patents and Rys et al. Some specific examples of preferred surfactants are used in the Examples herein.

Some examples of good lather enhancing detergent surfactants, mild ones, are e.g., sodium lauroyl sarcosinate, sodium cocoyl isethionate, alkyl glyceryl ether sulfonate, sulfonated fatty esters, paraffin sulfonates, and sulfonated fatty acids.

Numerous examples of other surfactants are disclosed in the patents incorporated herein by reference. They include other alkyl sulfates, anionic acyl sarcosinates, methyl acyl taurates, N-acyl glutamates, acyl isethionates, alkyl sulfosuccinates, alkyl phosphate esters, ethoxylated alkyl phosphate esters, trideceth sulfates, protein condensates, mixtures of ethoxylated alkyl sulfates and alkyl amine oxides, betaines, sultaines, and mixtures thereof. Included in the surfactants are the alkyl ether sulfates with 1 to 12 ethoxy groups, especially ammonium and sodium lauryl ether sulfates.

Alkyl chains for these other surfactants are $C_8$–$C_{22}$, preferably $C_{10}$–$C_{18}$. Alkyl glycosides and methyl glucose esters are preferred mild nonionics which may be mixed with other mild anionic or amphoteric surfactants in the compositions of this invention. Alkyl polyglycoside detergents are useful lather enhancers. The alkyl group can vary from about 8 to about 22 and the glycoside units per molecule can vary from about 1.1 to about 5 to provide an appropriate balance between the hydrophilic and hydrophobic portions of the molecule. Combinations of $C_8$–$C_{18}$, preferably $C_{12}$–$C_{16}$, alkyl polyglycosides with average degrees of glycosidation ranging from about 1.1 to about 2.7, preferably from about 1.2 to about 2.5, are preferred.

Sulfonated esters of fatty esters are preferred wherein the chain length of the carboxylic acid is $C_8$–$C_{22}$, preferably $C_{12}$–$C_{18}$; the chain length of the ester alcohol is $C_1$–$C_6$. These include sodium alpha sulfomethyl laurate, sodium alpha sulfomethyl coconate, and sodium alpha sulfomethyl tallowate.

Amine oxide detergents are good lather enhancers. Some preferred amine oxides are $C_8$–$C_{18}$, preferably $C_{10}$–$C_{16}$, alkyl dimethyl amine oxides and $C_8$–$C_{18}$, preferably $C_{12}$–$C_{16}$, fatty acyl amidopropyl dimethyl amine oxides and mixtures thereof.

Fatty acid alkanolamides are good lather enhancers. Some preferred alkanolamides are $C_8$–$C_{18}$, preferably $C_{12}$–$C_{16}$, monoethanolamides, diethanolamides, and monoisopropanolamides and mixtures thereof.

Other detergent surfactants are alkyl ethoxy carbonates having the general formula $$RO(CH_2CH_2O)_kCH_2COO{-}M^+$$

wherein R is a $C_{8-22}$ alkyl group, k is an integer ranging from 0 to 10, and M is a cation; and polyhydroxy fatty acid amides having the general formula:

$$R^2{-}\overset{\overset{\displaystyle O}{\|}}{C}{-}\overset{\overset{\displaystyle R^1}{|}}{N}{-}Z$$

wherein $R^1$ is H, a $C_{1\alpha}$ alkyl group, 2-hydroxy ethyl, 2-hydroxy propyl, or mixtures thereof, $R^2$ is a $C_{5-31}$ hydrocarbyl, and Z is a polyhydroxyhydrocarbyl having a linear hydrocarbyl chain with at least 3 hydroxyl groups directly connected to the chain, or an alkoxylated derivative thereof.

Betaines are good lather enhancers. Betaines such as $C_8$–$C_{18}$, preferably $C_{12}$–$C_{16}$, alkyl betaines, e.g., coco betaines or $C_8$–$C_{18}$, preferably $C_{12}$–$C_{16}$, acyl amido betaines, e.g., cocoamidopropyl betaine, and mixtures thereof, are preferred.

Some of the preferred surfactants are hygroscopic synthetic surfactants which absorb at least about 20% of their dry weight at 26° C. and 80% relative humidity in three days. Hygroscopic surfactants help to improve bar lather. Some preferred hygroscopic synthetic surfactants are listed below. Note that all are not hygroscopic.

Hygroscopicity of Some Surfactants

The hygroscopic surfactants are defined herein as having a minimum of 20% total moisture gain after 3 days at 26° C. and 80% Relative Humidity.

| | Total % Moisture Pick-Up* |
|---|---|
| Class: Anionics | |
| Sulfonates | |
| Sodium $C_8$ Glyceryl Ether Sulfonate | 39.8 |
| Sodiu $C_{12-14}$ Glyceryl Ether Sulfonate | 22.9 |
| Sodium $C_{16}$ Glyceryl Ether Sulfonate | 71.4 |
| Sodium Cocomonoglyceride Sulfonate | 3.5 |
| Sodium Salt of $C_{8-16}$ Alkyl Glyceryl Ether Sulfonates | |
| Alpha Sulfo Esters and Acids | |
| Sodium Alpha Sulfo Methyl Laurate/Myristate | 39.3 |
| Sodium Alpha Sulfo Methyl Myristate | 44.5 |
| Sodium Alpha Sulfo Hexyl Laurate | 23.2 |
| Sodium Alpha Sulfo Methyl/Hexyl Laurate and Myristate | 26.3 |
| Sodium Alpha Sulfo Methyl Palmitate | 3.7 |
| Sodium Alpha Sulfo Methyl Stearate | 4.2 |
| Sodium 2-Sulfo Lauric Acid | 0.2 |
| Sodium 2-Sulfo Palmitic Acid | 3.8 |
| Sodium 2-Sulfo Stearic Acid | 0.0 |
| $Na + R_1{-}C(SO_3{-}){-}CO_2R_2$ $R_1 = C_{8-14}$ alkyl; $R_2 = C_{1-8}$ alkyl | |
| Sodium Alkyl Isethionates | |
| Sodium Lauryl Isethionate | 31.7 |
| Sodium Cocoyl Isethionate | 11.0 |
| Sarcosinates | |
| Sodium Lauryl Sarcosinate | 8.8 |
| Sodium Stearyl Sarcosinate | 13.3 |
| Sodium Cocoyl Sarcosinate | 18.7 |
| Alkyl Sulfates | |
| Sodium Lauryl Sulfate | 28.2 |
| Sodium Laureth-1 Sulfate | 37.6 |
| Sodium Oleyl Sulfate | 20.3 |
| Sodium Cetearyl Sulfate | 4.7 |
| Sodium Cetyl Sulfate | 2.25 |
| $Na + R_1(OCH_2CH_2)_nOSO_3{-}$ $R_1 = C_{8-14}$ alkyl, $C_{16-20}$ alkyl(ene) with at least one double bond, n = 0–18 | |
| Acyl Glutamates | |

-continued

| | Total % Moisture Pick-Up* |
|---|---|
| Sodium Cocoyl Glutamate | 26.7 |
| Sodium Lauryl Glutamate | 17.8 |
| Sodium Myristyl Glutamate | 18.1 |
| Sodium Stearyl Glutamate | 12.0 |
| Alkyl Ether Carboxylates | |
| Sodium Laureth-5 Carboxylate | 32.2 |
| Sodium Palmityl-20 Carboxylate | 50.2 |
| $Na + R_1-(O-CH_2CH_2)_nCO_2-$ $R_1 = C_{8-18}$ alkyl, n = 1-30 | |
| Sulfosuccinates | |
| Disodium Laureth Sulfosuccinate | 33.6 |
| Phosphates | |
| Sodium Monoalkyl (70% $C_{12}$/30% $C_{14}$) Phosphate | 21.1 |
| Class: Amphoterics | |
| Betaines | |
| Coco Betaine | 70.0 |
| Cocoamidopropyl Betaine | 48.2 |
| Palmitylamidopropyl Betaine | 46.5 |
| Isostearamidopropyl Betaine | 44.3 |
| Sultaines | |
| Cocoamidopropylhydroxy Sultaine | 59.5 |
| Amine Oxides | |
| Palmityl Dimethyl Amine Oxide | 34.0 |
| Myristyl Dimethyl Amine Oxide | 46.0 |
| Cocoamidopropyl Amine Oxide | 43.3 |
| Protein Derived | |
| Na/TEA $C_{12}$ Hydrolyzed Keratin | 34.7 |

*3 days, 26° C./80% Relative Humidity

Polymeric skin mildness aids are disclosed in the Small et al. and Medcalf et al. patents. Both cationic polysaccharides and cationic synthetic polymers are disclosed. The cationic synthetic polymers useful in the present invention are cationic polyalkylene imines, ethoxypolyalklene imines, and poly[N-[-3-(dimethylammonio)propyl]-N'-[3-(ethyleneoxyethylene dimethylammonio)propyl]urea dichloride] the latter of which is available from Miranol Chemical Company, Inc. under the trademark of Miranol A-15, CAS Reg. No. 68555-36-2.

Preferred cationic polymeric skin conditioning agents of the present invention are those cationic polysaccharides of the cationic guar gum class with molecular weights of 1,000 to 3,000,000. More preferred molecular weights are from 2,500 to 350,000. These polymers have a polysaccharide backbone comprised of galactomannan units and a degree of cationic substitution ranging from about 0.04 per anhydroglucose unit to about 0.80 per anhydroglucose unit with the substituent cationic group being the adduct of 2,3-epoxypropyltrimethyl ammonium chloride to the natural polysaccharide backbone. Examples are JAGUAR C-14-S, C-15 and C-17 sold by Celanese Corporation. In order to achieve the benefits described in this invention, the polymer must have characteristics, either structural or physical which allow it to be suitably and fully hydrated and subsequently well incorporated into the soap matrix.

A mild skin pH cleansing bar of the present invention can contain from about 0.5% to about 20% of a mixture of a silicone gum and a silicone fluid wherein the gum:fluid ratio is from about 10:1 to about 1:10, preferably from about 4:1 to about 1:4, most preferably from about 3:2 to about 2:3.

Silicone gum and fluid blends have been disclosed for use in shampoos and/or conditioners in U.S. Pat. Nos.

4,906,459, Cobb et al., issued Mar. 6, 1990;
4,788,006, Bolich, Jr. et al., issued Nov. 29, 1988;
4,741,855, Grote et al., issued May 3, 1988;
4,728,457, Fieler et al., issued Mar. 1, 1988;
4,704,272, Oh et al., issued Nov. 3, 1987; and
2,826,551, Geen, issued Mar. 11, 1958, all of said patents being incorporated herein by reference.

The silicone component can be present in the bar at a level which is effective to deliver a skin mildness benefit, for example, from about 0.5% to about 20%, preferably from about 1.5% to about 16%, and most preferably from about 3% to about 12% of the composition. Silicone fluid, as used herein, denotes a silicone with viscosities ranging from about 5 to about 600,000 centistokes, most preferably from about 350 to about 100,000 centistokes, at 25° C. Silicone gum, as used herein, denotes a silicone with a mass molecular weight of from about 200,000 to about 1,000,000 and with a viscosity of greater than about 600,000 centistokes. The molecular weight and viscosity of the particular selected siloxanes will determine whether it is a gum or a field. The silicone gum and fluid are mixed together and incorporated into the compositions of the present invention.

Other ingredients of the present invention are selected for the various applications. E.g., perfumes can be used in formulating the skin cleansing products, generally at a level of from about 0.1% to about 2.0% of the composition. Alcohols, hydrotropes, colorants, and fillers such as talc, clay, water-insoluble, impalpable calcium carbonate and dextrin can also be used. Ceearyl alcohol is a mixture of cetyl and stearyl alcohols. Preservatives, e.g., sodium ethylenediaminetetraacetate (EDTA), generally at a level of less than 1% of the composition, can be incorporated in the cleansing products to prevent color and odor degradation. Antibacterials can also be incorporated, usually at levels up to 1.5%. The above patents disclose or refer to such ingredients and formulations which can be used in the bars of this invention, and are incorporated herein by reference.

Bar Appearance Aids

Bar appearance (water-retaining and/or shrinkage prevention) aids are preferably selected from the group consisting of:

compatible salt and salt hydrates;
water-soluble organics such as polyols, urea;
aluminosilicates and clays; and pl mixture thereof.

Some of these water-soluble organics serve as co-solvents which are used as bar firmness aids. They also serve to stabilize the appearance of the bar of the present invention. Some preferred water-soluble organics are propylene glycol, glycerine, ethylene glycol, sucrose, and urea, and other compatible polyols.

A particularly suitable water-soluble organic is propylene glycol. Other compatible organics include polyols, such as ethylene glycol or 1,7-heptane-diol, respectively the mono- and polyethylene and propylene glycols of up to about 8,000 molecular weight, any mono-$C_{1-4}$ alkyl esters thereof, sorbitol, glycerol, glycose, diglycerol, sucrose, lactose, dextrose, 2-pentanol, 1-butanol, mono- di- and triethanolammonium, 2-amino-1-butanol, and the like, especially the polyhydric alcohols.

The term "polyol" as used herein includes non-reducing sugar, e.g., sucrose. Sucrose will not reduce Fehling's solution and therefore is classified as a "non-reducing" disaccharide. Unless otherwise specified, the term "sucrose" as used herein includes sucrose, its derivatives, and similar non-reducing sugars and similar polyols which are substantially stable at a soap processing temperature of up to about 210° F. (98° C.), e.g., trehalose, raffinose, and stachyose; and sorbitol, lactitol and maltitol.

Compatible salt and salt hydrates are used to stabilize the bar soap appearance via the retention of water. Some preferred salts are sodium chloride, sodium sulfate, disodium hydrogen phosphate, sodium isethionate, sodium pyrophosphate, sodium tetraborate.

Generally, compatible salts and salt hydrates include the sodium, potassium, magnesium, calcium, aluminum, lithium, and ammonium salts of inorganic acids and small (6 carbons or less) carboxylic or other organic acids, corresponding hydrates, and mixtures thereof, are applicable. The inorganic salts include chloride, bromide, sulfate, metasilicate, orthophosphate, pyrophosphate, polyphosphate, metaborate, tetraborate, and carbonate. The organic salts include acetate, formate, isethionate, methyl sulfate, and citrate.

Water-soluble amine salts can also be used. Monoethanolamine, diethanolamine, and triethanolammonium (TEA) chloride salts are preferred.

Aluminosilicates and other clays are useful in the present invention. Some preferred clays are disclosed in U.S. Pat. Nos. 4,605,509 and 4,274,975, incorporated herein by reference.

Other types of clays include zeolite, kaolinite, montmorillonite, attapulgite, illite, bentonite, and halloysite. Another preferred clays is kaolin.

Waxes include petroleum based waxes (paraffin, microcrystalline, and petrolatum), vegetable based waxes (carnauba, palm wax, candelilla, sugarcane wax, and vegetable derived triglycerides) animal waxes (beeswax, spermaceti, wool wax, shellac wax, and animal derived triglycerides), mineral waxes (montar, ozokerite, and ceresin) and synthetic waxes (Fischer-Tropsch).

A preferred wax is used in the Examples herein. A useful wax has a melting point (M.P.) of from about 120° F. to about 185° F. (49°-85° C.), preferably from about 125° F. to about 175° F. (52°-79° C.). A preferred paraffin wax is a fully refined petroleum wax having a melting point ranging from about 130° F. to about 140° F. (49°-60° C.). This wax is odorless and tasteless and meets FDA requirements for use as coatings for food and food packages. Such paraffins are readily available commercially. A very suitable paraffin can be obtained, for example, from The Standard Oil Company of Ohio under the trade name Factowax R-133.

Other suitable waxes are sold by the National Wax Co. under the trade names of 9182 and 6971, respectively, having melting points of 131° F. and 130° F. (−55° C.). Another suitable wax is sold by Exxon Corp. under the trade name 158, having a melting point of 158° F. (70° C.).

The paraffin preferably is present in the bar in an amount ranging from about 5° % to about 20% by weight. The paraffin ingredient is used in the product to impart skin mildness, plasticity, firmness, and processability. It also provides a glossy look and smooth feel to the bar.

The paraffin ingredient is optionally supplemented by a microcrystalline wax. A suitable microcrystalline wax has a melting point ranging, for example, from about 140° F. (60° C.) to about 185° F. (85° C.), preferably from about 145° F. (62° C.) to about 175° F. (79° C.). The wax preferably should meet the FDA requirements for food grade microcrystalline waxes. A very suitable microcrystalline crystalline wax is obtained from Witco Chemical Company under the trade name Multiwax X-145A. The microcrystalline wax preferably is present in the bar in an amount ranging from about 0.5% to about 5% by weight. The microcrystalline wax ingredient imparts pliability to the bar at room temperatures.

EXAMPLES

The following examples are illustrative and are not intended to limit the scope of the invention. All levels and ranges, temperatures, results, etc., used herein, are approximations unless otherwise specified.

Description of Testing for Examples

Bar Hardness Test

1. The hardness of a bar is determined by measuring at 25° C. the depth of penetration (in mm) into the bar, as described herein. A separate elevated temperature bar hardness can also be measured at 49° C.

Bar Smear Test

2. The smear guide is determined by a (1) placing a soap bar on a perch in a 1400 mm diameter circular dish; (2) adding 200 ml of room temperature water to the dish such that the bottom 3 mm of the bar is submerged in water; (3) letting the bar soak overnight (17 hours); (4) turning the bar over and grading qualitatively for the combined amount of smear, and characteristics of smear, depth of smear on a scale where 10 equals no smear, 8.0–9.5 equals slow smear amount, 5.0–7.5 equals moderate smears similar to most marketed bars, and 4.5 or less equals very poor smear.

Commercial soap bars, e.g., SAFEGUARD®, ZEST®, IVORY®, and LAVA®, have smears of about 5, 6, 6, and 6, respectively.

A Frame Process for Making the Bars of the Present Invention

The cleansing bars in the Examples are made by the following general procedure unless otherwise specified:

1. Free fatty acid, propylene glycol, sodium chloride, and water (excluding water coming in with other raw materials) are mixed and heated to 82° C. (180° F.).
2. Other ingredients are added preferably in the following order and the temperature is maintained at ~82° C.: coco betaine; sodium lauroyl sarcosinate; or sodium alphasulfo methyl cocoate; kaolin clay; or hydrated zeolite (synthetic sodium aluminosilicate); and paraffin. Perfume is added last.
3. The molten liquid mixture is poured into shaped molds.
4. The molten liquid crystallizes (solidifies) on cooling to room temperature and the resultant bars are removed from the molds.

TABLE I

| Soft Compositions | | | |
|---|---|---|---|
| Comparative Examples: Ingredient | A Wt. % | B Wt. % | C Wt. % |
| Myristic Acid | 35.0 | 35.0 | — |
| Sodium Cocoyl Isethionate | — | — | 41.6 |
| Propylene Glycol | — | 25.0 | — |
| Water | 65.0 | 40.0 | 58.4 |

TABLE I-continued

| Soft Compositions | | | |
|---|---|---|---|
| Comparative Examples: Ingredient | A Wt. % | B Wt. % | C Wt. % |
| Penetration, mm | * | * | ** |

*Separates into two phases.
**Penetrates through Comp. C which is an aqueous phase without carboxylic acid.

TABLE II

| Soft Comp. D vs. Examples with Effective Levels of Bar Firmness Aids | | | | |
|---|---|---|---|---|
| Examples: Ingredient | Comp. D Wt. % | E Wt. % | F Wt. % | G Wt. % |
| Myristic Acid | 35 | 35 | 35 | 35 |
| Sodium Cocoyl Isethionate | 15 | 15 | 25 | 25 |
| Propylene Glycol | — | 5 | — | 5 |
| Water | 60 | 55 | 40 | 35 |
| Penetration, mm | 14.8 | 11.6 | 8.6 | 7.5 |

Comparative Examples A, B, and D are compared to Examples E, F, and G which all have 35% myristic acid as shown in Tables I and II. Comparative Example D has 60% water and is too soft. Examples E, F, and G demonstrate that the addition of effective amounts of an anionic surfactant, sodium cocoyl isethionate and propylene glycol, to the 35% free fatty acid and water are sufficient to form firm bars. Their penetration values are 11.6, 8.6, and 7.5, respectively. Note that a mixture of bar firmness aids with the addition of the co-solvent, propylene glycol, along with the surfactant, helps to form even firmer structure. Compare D vs. E and F vs. G. However, the addition of propylene glycol without surfactant is insufficient to form an acceptable bar. Comparative Example C shows that a mixture of only sodium cocoyl isethionate and water is very soft.

TABLE III

| Preferred Skin pH Compositions Especially for Freezer Bars | | | |
|---|---|---|---|
| Examples: Ingredient | EE Wt. % | FF Wt. % | GG Wt. % |
| 12-Hydroxy Stearic Acid | 14.5 | 18.8 | 14.6 |
| Sodium Lauroyl Isethionate | 34.5 | 32.3 | — |
| Sodium Cocoyl Isethionate | — | — | 34.8 |
| Sodium Alkyl Glyceryl Ether Sulfonate | — | 2.7 | 3.0 |
| Sodium Lauroyl Sarcosinate | 4.0 | 3.6 | 4.0 |
| Coco Betaine | 3.0 | 3.1 | — |
| Altowhite Clay | 4.0 | 3.4 | 4.0 |
| Sodium Chloride | 0.6 | — | 0.1 |
| Fragrance | 0.6 | — | 0.5 |
| Miscellaneous Minors | 4.0 | 5.6 | 6.0 |
| Water | 34.8 | 33.5 | 32.8 |

TABLE IV

| Compositions with Different Carboxylic Acids, Etc. | | | | |
|---|---|---|---|---|
| Examples: Ingredient | I Wt. % | J Wt. % | K Wt. % | L Wt. % |
| Palmitic Acid | 35.0 | — | — | — |
| Stearic Acid | — | 35.0 | — | — |
| Behenic Acid | — | — | 35.0 | — |
| 12-Hydroxy Stearic Acid | — | — | — | 35.0 |
| Sodium Cocoyl Isethionate | 25.0 | 25.0 | 25.0 | 25.0 |
| Water | 35.0 | 35.0 | 35.0 | 35.0 |
| pH | 4.9 | 5.0 | 5.0 | 5.0 |
| Penetration, mm | 8.5 | 6.7 | 5.3 | 4.6 |
| Smear | 10.0 | 10.0 | 10.0 | 10.0 |

The Examples in Table IV demonstrate that hard, non-smearing bars can be obtained with several different monocarboxylic acids: $C_{16}$ palmitic; $C_{18}$ stearic; $C_{22}$ behenic; 12HO-$C_{18}$, 12-hydroxy stearic acid, respectively, for Examples I-L.

TABLE V

| More Compositions with Different Carboxylic Acids, Etc. | | | | |
|---|---|---|---|---|
| Examples: Ingredient | M Wt. % | N Wt. % | O Wt. % | P Wt. % |
| 12-Hydroxy Stearic Acid | 14.0 | 4.0 | 10.0 | 9.0 |
| Myristic Acid | — | 14.0 | — | 9.0 |
| Sodium Lauroyl Isethionate | — | — | 34.0 | — |
| Sodium Cocoyl Isethionate | 30.0 | 44.0 | — | 44.0 |
| Sodium Linear Alkyl Benzene Sulfonate | 2.0 | 2.5 | 0.65 | 2.5 |
| Sodium Lauroyl Sarcosinate | — | — | 4.0 | — |
| Coco Betaine | — | — | 8.0 | — |
| Propylene Glycol | 14.0 | 5.0 | — | 5.0 |
| Paraffin Wax | — | — | 9.0 | — |
| Sodium Chloride | 2.0 | 2.0 | 5.7 | 2.0 |
| Miscellaneous Minors | 1.9 | 4.9 | 4.6 | 6.9 |
| Water | 36.1 | 23.6 | 20.1 | 23.6 |
| pH | 5.5 | 5.7 | 5.8 | 5.0 |
| Penetration, mm | 6.9 | 7.1 | 5.2 | 7.7 |
| Smear | 10.0 | 10.0 | 8.5 | 9.5 |

Examples M, N, O, and P show that firm bars with low or no smear can be obtained, respectively, with 12-hydroxy stearic acid, myristic acid, and mixtures of the two carboxylic acids. Examples M, N, and P contain sodium cocoyl isethionate and propylene glycol as bar firmness aids. Example 0 contains sodium lauroyl isethionate and sodium lauroyl sarcosinate for a total of 38% bar firmness aid; 8% coco betaine is added to boost lather. Note that these Examples list no soap.

TABLE VI

| More Compositions with Different Carboxylic Acids, Etc. | | | |
|---|---|---|---|
| Examples: Ingredient | O Wt. % | R Wt. % | S Wt. % |
| Myristic Acid | 20.0 | — | — |
| Stearic Acid | — | 20.0 | — |
| Behenic Acid | — | — | 21.0 |
| Sodium Lauroyl Isethionate | 6.2 | — | 25.0 |
| Sodium Cocoyl Isethionate | 18.5 | 35.0 | — |
| Sodium Linear Alkyl Benzene Sulfonate | 0.5 | 0.7 | 0.6 |
| Sodium Lauroyl Sarcosinate | — | — | 3.0 |
| Sodium Lauryl Methyl Ester Sulfonate | — | 3.0 | — |
| Sodium Paraffin Sulfonate | — | 2.0 | — |
| Coco Betaine | — | — | 8.0 |
| Corn Starch | 10.0 | — | 4.0 |
| Dextrin | — | — | 4.0 |
| Altowhite Clay | 3.6 | — | — |
| Paraffin Wax | 8.1 | — | — |
| Sodium Isethionate | 3.1 | 3.4 | 1.3 |
| Sodium Chloride | 0.3 | 0.3 | 6.6 |
| Glydant | 0.2 | — | — |
| Miscellaneous Minors | 4.0 | 5.1 | 2.1 |
| Water | 25.0 | 30.5 | 21.3 |
| pH | 5.8 | 5.5 | 5.0 |
| Penetration, mm | 4.0 | 7.7 | 6.8 |
| Smear | 10.0 | 10.0 | 9.5 |

Examples Q, R, and S show that myristic acid, stearic acid, and behenic acid can form firm, non-smearing bars in the absence of a co-solvent. Example R uses only sodium cocoyl isethionate. Example S uses only sodium lauroyl isethionate. Example Q uses a mixture of the two isethionates as the primary bar firmness aids.

TABLE VII

| Different Bar Firmness Aids | | | | |
|---|---|---|---|---|
| Examples: Ingredient | T Wt. % | U Wt. % | V Wt. % | X Wt. % |
| Myristic Acid | 35.0 | 35.0 | 35.0 | 35.0 |
| Sodium Cocoyl Isethionate | 25.0 | — | — | — |
| Glucose Amide | — | 25.0 | — | — |
| Sodium Laureth-3 Sulfate | — | — | 25.0 | — |
| Sodium Alkyl Ether Glyceryl Sulfonate | — | — | — | 25.0 |
| Propylene Glycol | 5.0 | 5.0 | 5.0 | 5.0 |
| Miscellaneous Minors | 1.6 | — | 1.1 | 2.4 |
| Water | 33.4 | 35.0 | 34.0 | 31.6 |
| Penetration, mm | 7.5 | 10.7 | 11.9 | 12.0 |

Examples T-X show several bar firmness aids: glucose amide, sodium laureth-3 sulfate, and sodium alkyl ether sulfonate. These bar firmness aids are less efficient than sodium cocoyl isethionate. Example U, V, and X bars have marginal, but acceptable, penetration.

TABLE VIII

| A Preferred Skin pH Frame Bar | |
|---|---|
| Examples Ingredient | Y Wt. % |
| Behenic Acid | 21.0 |
| Sodium Lauroyl Isethionate | 25.0 |
| Sodium Linear Alkyl Benzene Sulfonate | 0.6 |
| Sodium Lauroyl Sarcosinate | 3.0 |
| Coco Betaine | 8.0 |
| Cetearyl Sulfate | 3.0 |
| Dextrin | 4.0 |
| Sodium Isethionate | 1.35 |
| Sodium Chloride | 6.63 |
| Miscellaneous Minors | 2.14 |
| Water | 21.3 |
| pH | 5.6 |
| Penetration, mm (25° C.) | 6.8 |
| Penetration, mm (49° C.) | 8.8 |
| Smear | 9.5 |
| Lather, Soil | 3.0 |

Example Y is a preferred skin pH frame bar that has excellent firmness, even at elevated storage conditions (49° C.), very little smear, and good lather.

What is claimed is:

1. A framed, ultra mild, weakly acidic skin pH (about 4 to 6.5) cleansing bar comprising: at least two phases and a sum total of from about 5% to about 50% of free monocarboxylic acid or a mixture of said free and neutralized monocarboxylic acid; from about 15% to about 65% of an anionic and/or nonanionic bar firmness aid; and from about 15% to about 55% water by weight of said bar;

wherein said bar firmness aid is selected from the group consisting of:

I. from about 10% to about 50% by weight of a synthetic surfactant wherein said synthetic surfactant is selected from the group consisting of: alkyl sulfates, paraffin sulfonates, alkyl glyceryl ether sulfonates, anionic acyl sarcosinates, methyl acyl taurates, linear alkyl benzene sulfonates, N-acyl glutamates, alkyl glucosides, alpha sulfo fatty acid esters, acyl isethionates, glucose amides, alkyl sulfosuccinates, alkyl ether carboxylates, alkyl phosphate esters, ethoxylated alkyl phosphate esters, methyl glucose esters, protein condensates, the alkyl ether sulfates with 1 to 12 ethoxy groups, and mixtures thereof, wherein said surfactants contain $C_8$–$C_{22}$ alkylene chains; and mixtures thereof; and II. from zero to about 40% by weight of a co-solvent wherein said co-solvent is selected from the group consisting of:

(a) non-volatile, water-soluble nonionic organic solvents selected from the group consisting of: a polyol of the structure:

$$R_3-O(CH_2-\underset{\underset{R_4}{|}}{CH}O)_kH$$

where $R_3$=H, $C_1$–$C_4$ alkyl; $R_4$=H, $CH_3$; and k=1–200; $C_2$–$C_{10}$ alkane diols; sorbitol; glycerine; sugars; sugar derivatives; urea; and ethanol amines of the general structure $(HOCH_2CH_2)_xNH_y$ where x=1-3; y=0-2; and x+y=3;

(b) alcohols of from 1 to 5 carbon atoms; and mixtures thereof; and

III. mixtures of (a) and (b);

wherein said free carboxylic acid is from about 85% to about 100% by weight of said mixture of free and neutralized carboxylic acid; and conversely, said neutralized carboxylic acid is from 0% to about 15% by weight of said mixture of free and neutralized carboxylic acid;

wherein one of said phases comprises a rigid crystalline phase skeleton structure comprising an interlocking, open three-dimensional mesh of elongated crystals comprising: (a) said free monocarboxylic acid, or (b) said mixture of said free and neutralized carboxylic acid;

wherein another of said phases is an aqueous phase mix; said mix (when measured alone) having a penetration value of greater than 12 mm to complete penetration at 25° C.; and wherein said cleansing bar has a penetration value of from zero up to 12 mm as measured at 25° C. using a 247 gram Standard Weighted Penetrometer Probe having a conical needle attached to a 9 inch (22.9 cm) shaft, weighing 47 grams with 200 grams on top of said shaft for a total of said 247 grams, said conical needle having a 19/32 inch (1.51 cm) top and a 1/32 inch (0.08 cm) point.

2. The ultra mild, weakly acidic skin pH cleansing bar of claim 1 wherein at least 80% of said monocarboxylic acid has the following general formula:

$$H-(CH_2)_a-\underset{\underset{X}{|}}{CH}-(CH_2)_b-CO_2-H$$

wherein:

a+b=10 to 20 each a, b=0 to 20

X=H, OR, $$O-\overset{\overset{O}{\|}}{C}-R_1,$$

R, or mixtures thereof

R=$C_1$–$C_3$ alkyl, H, or mixtures thereof $R_1$=$C_1$–$C_3$ alkyl.

3. The ultra mild, weakly acidic skin pH cleansing bar of claim 2 wherein said monocarboxylic acid is selected from: X=H, and a+b=12-20; or X=OH, a=10-16, b=0; or 12-hydroxy stearic acid or mixtures thereof.

4. The firm, ultra mild, weakly acidic skin pH cleansing bar of claim 1 wherein said bar also has a penetration value of less than 12 mm at 49° C.

5. The ultra mild, weakly acidic skin pH cleansing bar of claim 1 wherein said bar has a penetration value of from about 3 mm to about 9 mm.

6. The ultra mild, weakly acidic skin pH cleansing bar of claim 1 wherein said neutralized carboxylic acid is a sodium salt;

wherein said essentially free carboxylic acid is from about 10% to about 30% by weight of the bar;

wherein said synthetic surfactant is from about 15% to about 40% by weight of said bar; and said synthetic surfactant contains $C_{10}$–$C_{18}$ alkylene chains;

wherein said co-solvent is from 0% to about 15% by weight of said bar; and wherein said water is from about 20% to about 30% by weight of said bar.

7. The ultra mild, weakly acidic skin pH cleansing bar of claim 6 wherein said bar has a penetration value of less than 12 mm at 49° C.

8. The ultra mild, weakly acidic skin pH cleansing bar of claim 2 wherein any neutralized monocarboxylic acid is from 0% to about 5% by weight of said essentially free monocarboxylic acid;

wherein said neutralized carboxylic acid is a sodium salt;

wherein said essentially free monocarboxylic acid is from about 15% to about 25% by weight of said bar;

wherein said monocarboxylic acid X=H and a+b=-12-20 or said monocarboxylic acid is 12-hydroxy stearic acid; and wherein said water is from about 20% to about 30% by weight of said bar.

9. The ultra mild, weakly acidic skin pH cleansing bar of claim 8 wherein said monocarboxylic acid is selected from the group consisting of myristic acid, behenic acid, and 12-hydroxy stearic acid and mixtures thereof.

10. The ultra mild, weakly acidic skin pH cleansing bar of claim 6 wherein said synthetic surfactant level is from about 20% to about 30% by weight of said bar; and wherein said synthetic surfactant is a sodium salt and is selected from the group consisting of: alkyl sulfates, alkyl glyceryl ether sulfonates, linear alkyl benzene sulfonates, alpha sulfo fatty acid esters, acyl isethionates, glucose amides, ethoxylated alkyl ether sulfates with 1 to 6 ethoxy groups, and mixtures thereof, wherein said surfactants contain $C_{10}$–$C_{18}$ alkylene chains; and mixtures thereof.

11. The ultra mild, weakly acidic skin pH cleansing bar of claim 10 wherein said synthetic surfactant is a sodium acyl isethionate.

12. The ultra mild, weakly acidic skin pH cleansing bar of claim 11 wherein said sodium acyl isethionate is selected from the group consisting of sodium cocoyl isethionate and sodium lauroyl isethionate, and mixtures thereof.

13. The ultra mild, weakly acidic skin pH cleansing bar of claim 6 wherein said co-solvent level is from about 2% to about 15% by weight of said bar, and wherein said co-solvent is selected from the group consisting of: said polyol wherein $R_3$=H, and k=1-5; glycerine; sugars; sugar derivatives; urea, said ethanol amines, and mixtures thereof.

14. The ultra mild, weakly acidic skin pH cleansing bar of claim 13 wherein said co-solvent is from about 2% to about 10% by weight of said bar, and wherein said co-solvent is selected from the group consisting of: propylene glycol, sucrose, lactose, glycerine, and mixtures thereof.

15. The ultra mild, weakly acidic skin pH cleansing bar of claim 1 wherein said bar contains from about 0.1% to about 60% of other cleansing bar soap ingredients selected from the group consisting of:

from about 0.5% to about 1% said potassium soap;

from about 0.5% to about 1% triethanolammonium soap;

from about 1% to about 40% of impalpable water-insoluble materials selected from the group consisting of calcium carbonate and talc;

from about 0.1% to about 20% of a polymeric skin feel aid;

from about 0.5% to about 25% of aluminosilicate clay and/or other clays; wherein said aluminosilicates and clays are selected from the group consisting of zeolites; kaolin, kaolinite, montmorillonite, attapulgite, illite, bentonite, halloysite, and calcined clays;

from about 1% to about 40% of salt and salt hydrates; and mixtures thereof; wherein said salt and salt hydrate have a cation selected from the group consisting of: sodium, potassium, magnesium, calcium, aluminum, lithium, ammonium, monoethanol ammonium, diethanolammonium, and triethanolammonium; and wherein said salt and salt hydrate have an anion selected from the group consisting of: chloride, bromide, sulfate, metasilicate, orthophosphate, pyrophosphate, polyphosphate, metaborate, tetraborate, carbonate, bicarbonate, hydrogen phosphate, isethionate, methyl sulfate, and mono- and polycarboxylate of 6 carbon atoms or less;

from about 0.5% to about 30% of a starch;

from about 1% to about 20% of an amphoteric co-surfactant selected from the group consisting of alkyl betaines, alkyl sultaines, and trialkyl amine oxides; and mixtures thereof;

from about 0.1% to about 40% of a hydrophobic material selected from the group consisting of: microcrystalline wax, petrolatum, carnauba wax, palm wax, candelilla wax, sugarcane wax, vegetable derived triglycerides, beeswax, spermaceti, lanolin, wood wax, shellac wax, animal derived triglycerides, montar, paraffin, ozokerite, ceresin, and Fischer-Tropsch wax.

16. The ultra mild, weakly acidic skin pH cleansing bar of claim 15 wherein the level of said amphoteric co-surfactant is from about 3% to about 10% and said amphoteric co-surfactant is selected from the group consisting of: cocobetaine, cocoamidopropylbetaine, cocodimethylamine oxide, and cocoamidopropyl hydroxysultaine.

17. The ultra mild, weakly acidic skin pH cleansing bar of claim 15 wherein said bar contains from about 2% to about 35% of said hydrophobic material; said hydrophobic material having a melting point of from about 49° C. (120° F.) to about 85° C. (185° F.) and is selected from the group consisting of said petrolatum and wax, and mixtures thereof.

18. The ultra mild, weakly acidic skin pH cleansing bar of claim 17 wherein said bar comprises from about 3% to about 15% by weight of the bar of paraffin wax.

19. The ultra mild, weakly acidic skin pH cleansing bar of claim 15 wherein said bar contains from about 1% to about 20% of said salts and said salt is selected from the group constituting of: sodium chloride, sodium sulfate, disodium hydrogen phosphate, sodium pyrophosphate, sodium tetraborate, sodium acetate, sodium citrate, and sodium isethionate, and mixtures thereof.

20. The ultra mild, weakly acidic skin pH cleansing bar of claim 19 wherein said bar contains said salt at a level of from about 4% to about 15% and said salt is selected from the group consisting of sodium chloride and sodium isethionate.

21. The ultra mild, weakly acidic skin pH cleansing bar of claim 15 wherein said bar contains: from about 1% to about 15% by weight of said impalpable water-insoluble materials; from about 0.1% to about 3%, of said polymeric skin feel aid, said polymeric skin feel aid selected from the group consisting of guar, quaternized guar, and quaternized polysaccharides; from about 1% to about 15% said aluminosilicate and/or other clays; and from about 1% to about 15% said starch; wherein said starch is selected from the group consisting of corn starch and dextrin.

22. The ultra mild, weakly acidic skin pH cleansing bar of claim 1 wherein said aqueous phase mix alone contains from about 20% to about 95% water by weight of said aqueous phase.

23. The ultra mild, weakly acidic skin pH cleansing bar of claim 1 wherein said aqueous phase contains from about 35% to about 75% water by weight of said aqueous phase.

24. The ultra mild, weakly acidic skin pH cleansing bar of claim 1 wherein said bar has a penetration value of from about 3 mm to about 9 mm for said 25 mm bar sample.

25. The ultra mild, weakly acidic skin pH cleansing bar of claim 1 wherein said bar has miscellaneous non-carboxylic acid phases comprising droplets or crystals selected from waxes, petrolatum, and clays.

26. The ultra mild, weakly acidic skin pH cleansing bar of claim 1 wherein said bar has miscellaneous non-carboxylic acid phases comprising droplets or crystals of synthetic surfactant.

* * * * *